US007597141B2

(12) United States Patent
Rouse et al.

(10) Patent No.: US 7,597,141 B2
(45) Date of Patent: Oct. 6, 2009

(54) FLOW NOZZLE ASSEMBLY

(75) Inventors: William T. Rouse, Montgomery, TX (US); James R. Hardin, Lafayette, LA (US); Pete Olenick, Spring, TX (US); John R. Setterberg, Jr., Huntsville, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 277 days.

(21) Appl. No.: 11/551,571

(22) Filed: Oct. 20, 2006

(65) Prior Publication Data

US 2007/0062686 A1 Mar. 22, 2007

Related U.S. Application Data

(63) Continuation-in-part of application No. 11/148,405, filed on Jun. 8, 2005, now Pat. No. 7,373,989, which is a continuation-in-part of application No. 10/876,249, filed on Jun. 23, 2004, now abandoned.

(51) Int. Cl.
*E21B 43/08* (2006.01)
*E21B 43/04* (2006.01)

(52) U.S. Cl. ..... 166/227; 166/222; 166/278

(58) Field of Classification Search ..... 166/378, 166/278, 51, 227, 222, 311; 138/140, 148
See application file for complete search history.

(56) References Cited

U.S. PATENT DOCUMENTS

| | | | | |
|---|---|---|---|---|
| 4,476,020 | A * | 10/1984 | Cheetham | 210/289 |
| 4,498,543 | A | 2/1985 | Pye et al. | |
| 5,842,516 | A | 12/1998 | Jones | |
| 6,227,303 | B1 | 5/2001 | Jones | |
| 6,491,097 | B1 | 12/2002 | Oneal et al. | |
| 6,557,634 | B2 | 5/2003 | Hailey, Jr. et al. | |

FOREIGN PATENT DOCUMENTS

| | | |
|---|---|---|
| EP | 1 609 946 | 3/2006 |
| GB | 640310 | 7/1950 |
| GB | 2178342 | 2/1987 |
| GB | 2 426 989 | 12/2006 |
| WO | WO 2004/018837 | 3/2004 |

OTHER PUBLICATIONS

GB Search Report, Application No. GB0720462.1 dated Feb. 15, 2008.
Canadian Office Action, Application No. 2,608,050, dated Jul. 6, 2009.

* cited by examiner

*Primary Examiner*—Kenneth Thompson
(74) *Attorney, Agent, or Firm*—Patterson & Sheridan, LLP

(57) ABSTRACT

Methods and apparatus provides an improved shunt nozzle which is part of an alternative pathway for a slurry to by-pass an obstruction such as a sand bridge during gravel packing. The nozzle includes a hardened insert that lines a surface of an aperture in a shunt. A jacket secured to the shunt receives the insert, which is trapped from movement relative to the jacket.

37 Claims, 7 Drawing Sheets

FLOW NOZZLE ASSEMBLY

CROSS-REFERENCE TO RELATED APPLICATIONS

This application is a continuation-in-part of U.S. patent application Ser. No. 11/148,405, filed Jun. 8, 2005, now U.S. Pat. No. 7,373,989 issued May 20, 2008 which is a continuation-in-part of U.S. patent application Ser. No. 10/876,249, filed Jun. 23, 2004, which are all herein incorporated by reference.

BACKGROUND OF THE INVENTION

1. Field of the Invention

Embodiments of the invention generally relate to gravel packing of wells. In particular, the invention relates to methods and apparatuses suitable for injecting gravel slurry at high flow rates within the well bore being packed.

2. Description of the Related Art

Hydrocarbon wells, especially those having horizontal wellbores, typically have sections of wellscreen comprising a perforated inner tube surrounded by a screen portion. The screen blocks the flow of unwanted materials into the wellbore. Despite the wellscreen, some contaminants and other unwanted materials like sand, still enter the production tubing. The contaminants occur naturally and are also formed as part of the drilling process. As production fluids are recovered, the contaminants are also pumped out of the wellbore and retrieved at the surface of the well. By controlling and reducing the amount of contaminants that are pumped up to the surface, the production costs and valuable time associated with operating a hydrocarbon well will likewise be reduced.

One method of reducing the inflow of unwanted contaminants includes gravel packing. Normally, gravel packing involves the placement of gravel in an annular area formed between the screen portion of the wellscreen and the wellbore. In a gravel packing operation, a slurry of liquid, sand and gravel ("slurry") is pumped down the wellbore where it is redirected into the annular area with a cross-over tool. As the gravel fills the annulus, it becomes tightly packed and acts as an additional filtering layer along with the wellscreen to prevent collapse of the wellbore and to prevent the contaminants from entering the stream of production fluids pumped to the surface. Ideally, the gravel uniformly packs around the entire length of the wellscreen, completely filling the annulus. However, during gravel packing, the slurry may become less viscous due to loss of fluid into the surrounding formations or into the wellscreen. The loss of fluid causes sand bridges to form. Sand bridges create a wall bridging the annulus and interrupting the flow of the slurry, thereby preventing the annulus from completely filling with gravel.

The problem of sand bridges is illustrated in FIG. 1, which is a side view, partially in section of a horizontal wellbore with a wellscreen therein. The wellscreen 30 is positioned in the wellbore 14 adjacent a hydrocarbon bearing formation therearound. An annulus 16 is formed between the wellscreen 30 and the wellbore 14. FIG. 1 illustrates the path of gravel 13 as it is pumped down the production tubing 11 in a slurry and into the annulus 16 through a crossover tool 33.

Also illustrated in FIG. 1 is a formation including an area of highly permeable material 15. The highly permeable area 15 can draw liquid from the slurry, thereby dehydrating the slurry. As the slurry dehydrates in the permeable area 15 of the formation, the remaining solid particles form a sand bridge 20 and prevent further filling of the annulus 16 with gravel. As a result of the sand bridge, particles entering the wellbore from the formation are more likely to enter the production string and travel to the surface of the well. The particles may also travel at a high velocity, and therefore more likely damage and abrade the wellscreen components.

In response to the sand-bridging problem, shunt tubes have been developed creating an alternative path for gravel around a sand bridge. According to this conventional solution, when a slurry of sand encounters a sand bridge, the slurry enters an apparatus and travels in a tube, thereby bypassing the sand bridge to reenter the annulus downstream.

FIG. 2 shows a sectional view of a prior art nozzle assembly 50 disposed on a shunt tube 55. The construction for an exit point from the shunt tube 55 involves drilling a hole 80 in the side of the tube, typically with an angled aspect, in approximate alignment with the slurry flow path 75, to facilitate streamlined flow. The nozzle assembly 50, having a tubular outer jacket 65, and a tubular carbide insert 60, is held in alignment with the drilled hole 80, and the outer jacket is attached to the tube with a weld 70, trapping the carbide insert 60 against the tube 55, in alignment with the drilled hole 80. The nozzle assembly 50 also has an angled aspect, pointing downward and outward, away from the tube 55. Sand slurry exiting the tube 55 through the nozzle 50 is routed through the carbide insert 60, which is resistant to damage from the highly abrasive slurry.

Both the method of constructing the nozzle 50 and the nozzle itself suffer from significant drawbacks. Holding the nozzle assembly 50 in correct alignment while welding is cumbersome. A piece of rod (not shown) must be inserted through the nozzle assembly 50, into the drilled hole 80, to maintain alignment. This requires time, and a certain level of skill and experience. During welding, the nozzle assembly 50 can shift out of exact alignment with the drilled hole in the tube due to either translational or rotational motion. After welding, exact alignment between the nozzle 50 and the drilled hole 80 is not assured. Because the carbide insert 60 actually sits on the surface of the tube 55, the hole 80 in the tube wall is part of the exit flow path 75. Abrasive slurry, passing through the hole, may cut through the relatively soft tube 55 material, and bypass the carbide insert 60 entirely, causing tube failure.

Therefore, there exists a need for an improved nozzle assembly for a shunt tube and a method for attaching the nozzle to the shunt tube.

SUMMARY OF THE INVENTION

For some embodiments, a nozzle assembly for use in a gravel pack tool having an aperture through a wall of a shunt along the tool includes an insert having a proximal end at least partially lining the aperture, wherein the insert has an outward facing shoulder distal to the aperture, and a jacket concentrically surrounding the insert, wherein the jacket is secured to an outer surface of the wall and has a face in abutment with the shoulder.

In some embodiments, an apparatus for use in a wellbore includes a wellscreen assembly, at least one shunt disposed on the wellscreen assembly and having an aperture through a wall of the shunt, an insert having a proximal end at least partially lining the aperture, wherein the insert has an outward facing shoulder distal to the aperture, a jacket concentrically surrounding the insert, wherein a first end of the jacket is secured to an outer surface of the wall and a second end of the jacket terminates in abutting contact with the shoulder, and an open cap secured to the jacket, wherein an inward facing shoulder of the cap abuts a distal terminus of the insert.

According to some embodiments, a nozzle assembly for use in a gravel pack tool having an aperture through a wall of a shunt along the tool includes an insert having a proximal end at least partially lining the aperture, wherein the insert has an enlarged outer diameter at a distal end of the insert relative to the aperture, a jacket concentrically surrounding the insert, wherein the jacket is secured to an outer surface of the wall at a first end and has an inner diameter smaller than the enlarged outer diameter of the insert, which abuts a second end of the jacket at the enlarged outer diameter, and an open cap secured to the second end of the jacket and extending beyond the enlarged outer diameter of the insert, wherein an opening through the cap has a restricted diameter smaller than the enlarged outer diameter of the insert, which is thereby trapped relative to the jacket.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
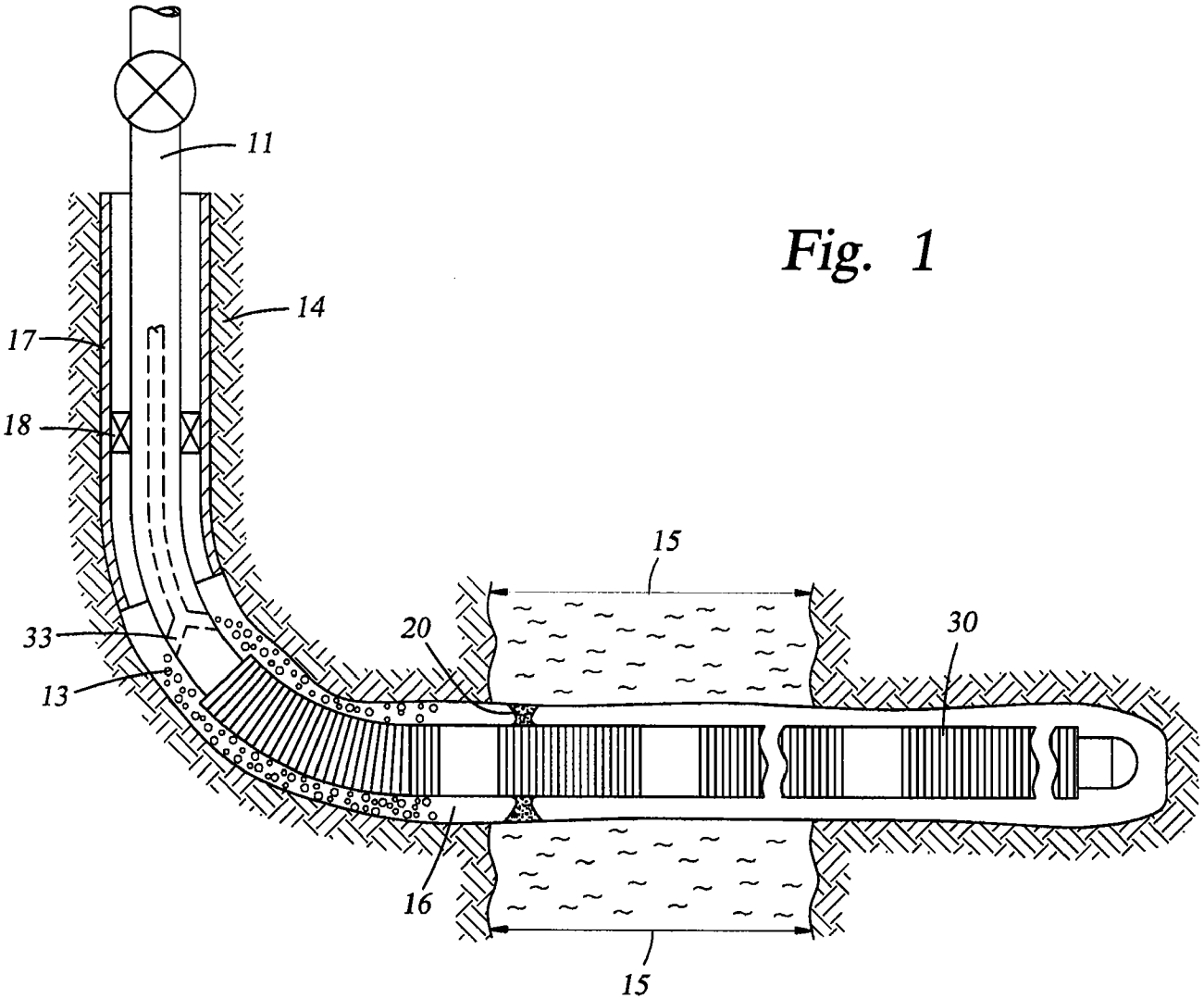
FIG. 1 is a side view, partially in section of a horizontal wellbore with a wellscreen therein.
Figure 2:
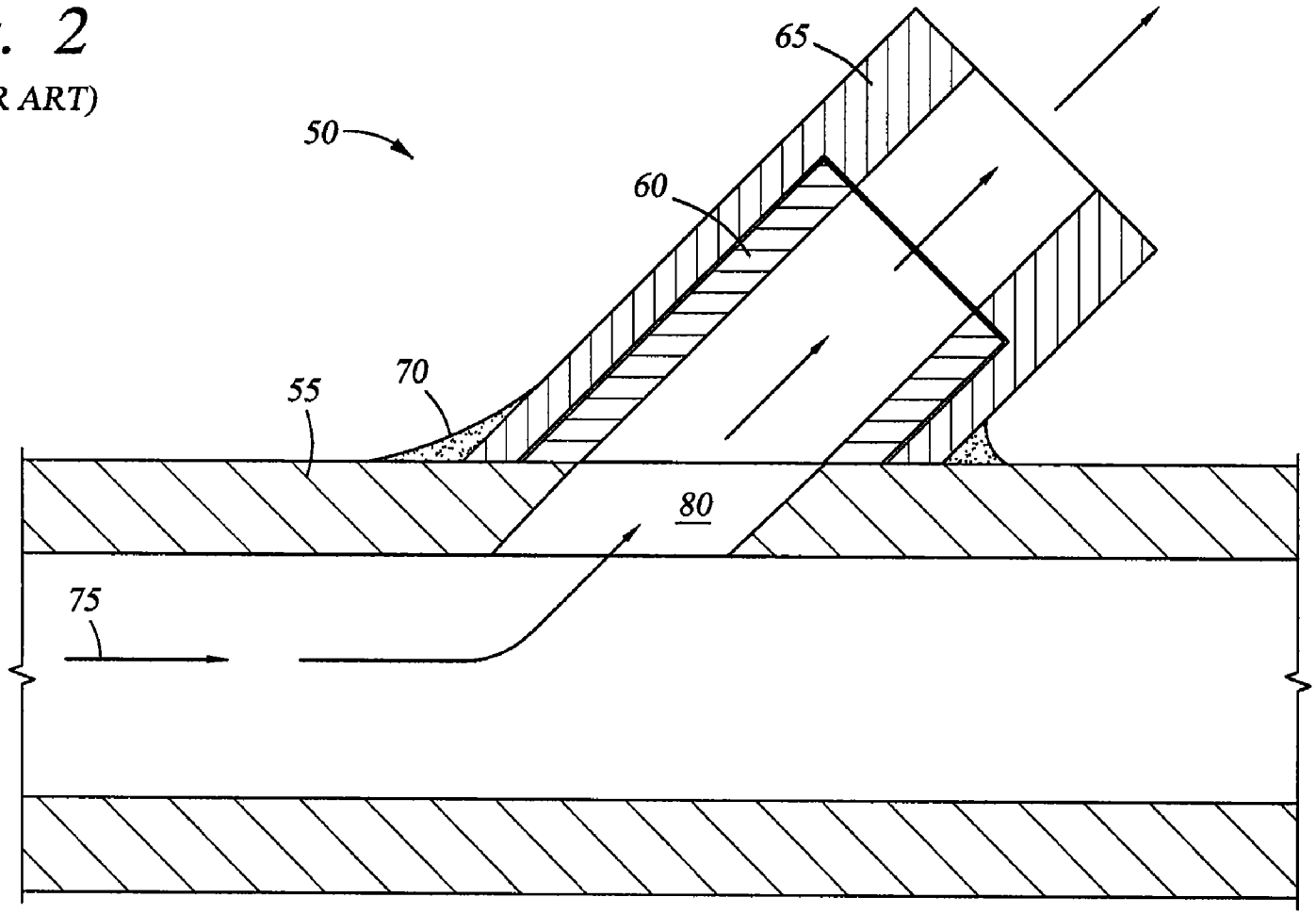
Fig. 2 (PRIOR ART)
FIG. 2 is a sectional view of a prior art flow nozzle configuration.
Figure 3A:
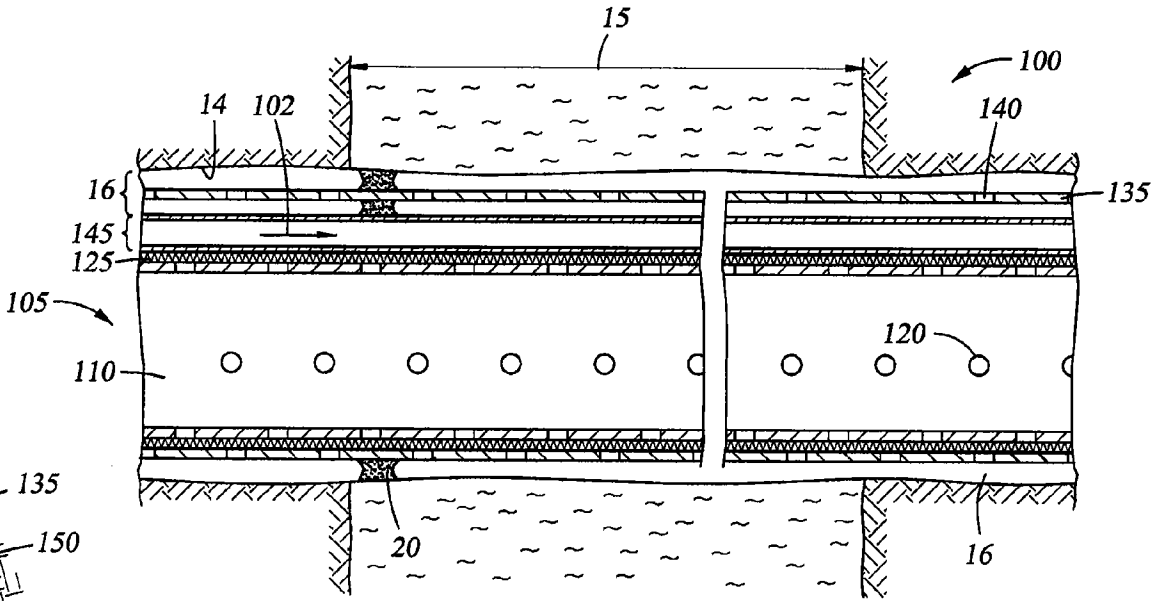
FIG. 3A is a sectional view, taken along line 3A-3A of FIG. 3, of the gravel pack apparatus positioned within wellbore adjacent a highly permeable area of a formation.
Figure 3B:
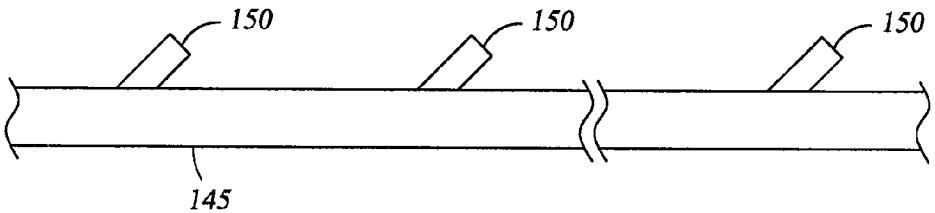
FIG. 3B is a schematic of one of the shunts showing the placement of nozzles along the shunt.
Figure 3:
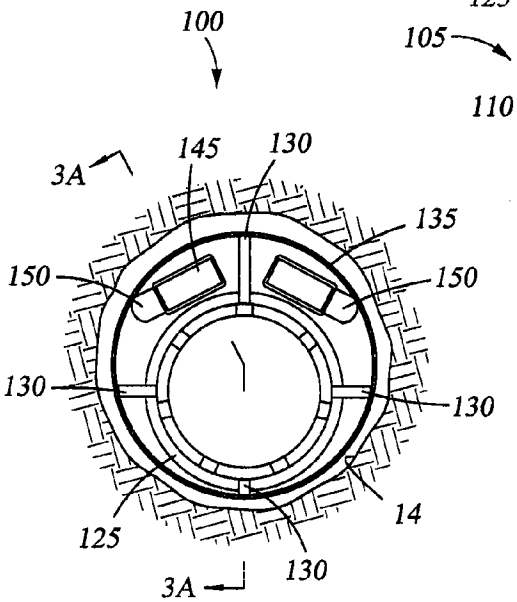
FIG. 3 is a top end view of a gravel pack apparatus, according to one embodiment of the present invention, positioned within a wellbore.

FIG. 3 is a top end view of a gravel pack apparatus 100, according to one embodiment of the present invention, positioned within wellbore 14. FIG. 3A is a sectional view, taken along line 3A-3A of FIG. 3, of the gravel pack apparatus 100 positioned within wellbore 14 adjacent the highly permeable area 15 of a formation. Although apparatus 100 is shown in a horizontal wellbore, it can be utilized in any wellbore. Apparatus 100 may have a "cross-over" sub 33 (see FIG. 1) connected to its upper end which, in turn, is suspended from the surface on a tubing or work string (not shown). Apparatus 100 can be of one continuous length or it may consist of sections (e.g. 20 foot sections) connected together by subs or blanks (not shown). Preferably, all components of the apparatus 100 are constructed from a low carbon or a chrome steel unless otherwise specified; however, the material choice is not essential to the invention.

Apparatus 100 includes a wellscreen assembly 105. As shown, wellscreen assembly 105 comprises a base pipe 110 having perforations 120 through a wall thereof. Wound around an outer side of the base pipe 110 is a wire wrap 125 configured to permit the flow of fluids therethrough while blocking the flow of particulates. Alternatively, wellscreen assembly 105 may be any structure commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof).

Also disposed on the outside of the base pipe 110 are two shunts 145. The number and configuration of shunts 145 is not essential to the invention. The shunts 145 may be secured to the base pipe 110 by rings (not shown). At an upper end (not shown) of the apparatus 100, each shunt 145 is open to the annulus. Each one of the shunts 145 is rectangular with a flow bore therethrough; however, the shape of the shunts is not essential to the invention. Disposed on a sidewall of each shunt is a nozzle 150.

FIG. 3B is a schematic of one of the shunts 145 showing the placement of nozzles 150 along the shunt 145. As shown, a plurality of nozzles 150 are disposed axially along each shunt 145. Each nozzle 150 provides slurry fluid communication between one of the shunts 145 and an annulus 16 between the wellscreen 105 and the wellbore 14. As shown, the nozzles 150 are oriented to face an end of the wellbore 14 distal from the surface (not shown) to facilitate streamlined flow of the slurry 13 therethrough.

Disposed on the outside of the base pipe 110 are a plurality of centralizers 130 that can be longitudinally separated from a length of the base pipe 110 that has the perforations 120 and the wire wrap 125. Additionally, a tubular shroud 135 having perforations 140 through the wall thereof can protect shunts 145 and wellscreen 105 from damage during insertion of the apparatus 100 into the wellbore. The perforations 140 are configured to allow the flow of slurry 13 therethrough.

In operation, apparatus 100 is lowered into wellbore 14 on a workstring and is positioned adjacent a formation. A packer 18 (see FIG. 1) is set as will be understood by those skilled in the art. Gravel slurry 13 is then pumped down the workstring and out the outlet ports in cross-over sub 33 to fill the annulus 16 between the wellscreen 105 and the wellbore 14. Since the shunts 145 are open at their upper ends, the slurry 13 will flow into both the shunts and the annulus 16. As the slurry 13 loses liquid to the high permeability portion 15 of the formation, the gravel carried by the slurry 13 is deposited and collects in the annulus 16 to form the gravel pack. If the liquid is lost to a permeable stratum 15 in the formation before the annulus 16 is filled, the sand bridge 20 is likely to form which will block flow through the annulus 16 and prevent further filling below the bridge. If this occurs, the gravel slurry will continue flowing through the shunts 145, bypassing the sand bridge 20, and exiting the various nozzles 150 to finish filling annulus 16. The flow of slurry 13 through one of the shunts 145 is represented by arrow 102.

Figure 4A:
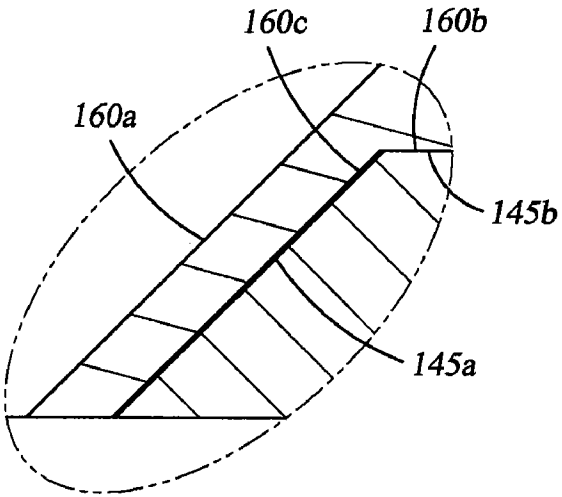
FIG. 4A is an enlargement of a portion of FIG. 4 indicated by the dotted oval labeled 4A.
Figure 4:
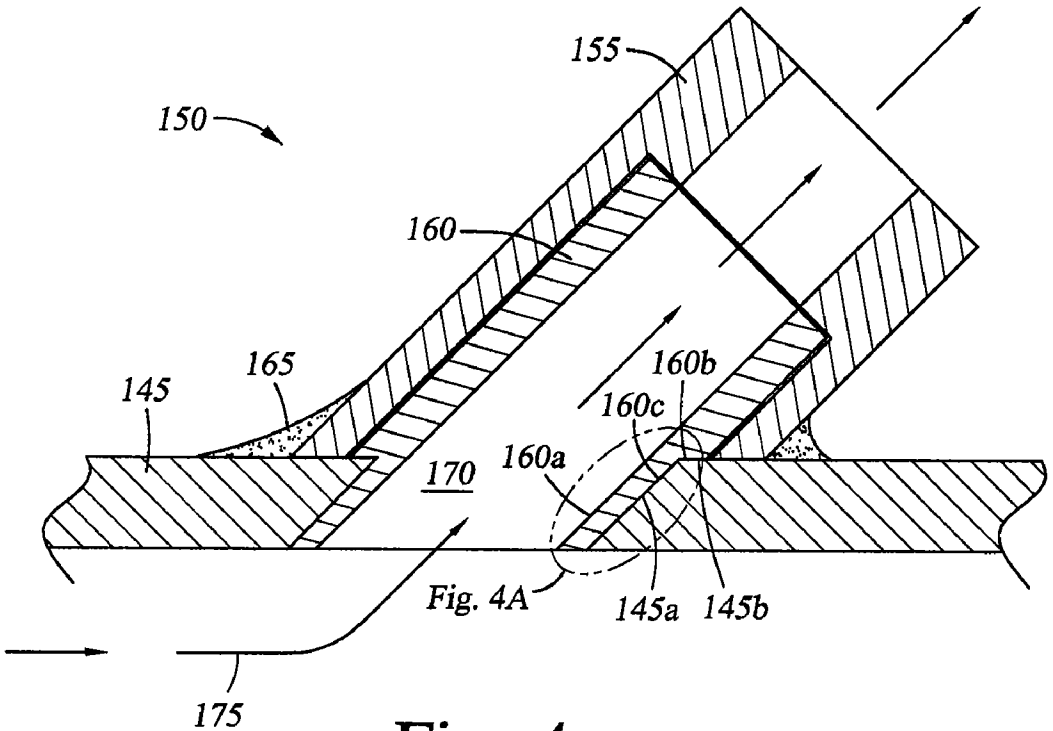
FIG. 4 is a sectional view of a nozzle assembly, according to one embodiment of the present invention, disposed on one of the shunts.

FIG. 4 is a sectional view of a nozzle assembly 150, according to one embodiment of the present invention, disposed on one of the shunts 145. FIG. 4A is an enlargement of a portion of FIG. 4 indicated by the dotted oval labeled 4A. The nozzle assembly 150 comprises an insert 160 with a flow bore therethrough, that features a lip 160*a* that extends into a drilled hole 170 in a wall of the shunt 145, thereby lining a surface 145*a* of the shunt wall that defines the hole 170. Preferably, the insert is made from a hard material, e.g., carbide, relative to the material of the shunt 145. As shown, the length of the lip 160*a* is substantially the same as the wall thickness of the shunt 145. However, the lip 160*a* may be substantially longer or shorter than the wall thickness of the shunt 145. Preferably, the lip 160*a* features a slight taper on an outer surface 160*c* for seating on the surface 145*a* of the shunt wall, thereby providing a slight interference fit; however, the taper is not essential to the invention. The insert 160 also features a shoulder 160*b* which seats with a surface 145*b* of the shunt wall proximate the hole 170, thereby providing a rigid stop limiting the depth to which lip 160*a* can penetrate the shunt 145. An outer jacket 155 having a flow bore therethrough and a recess configured to receive a portion of the insert 160 may then be easily slipped on and secured to the shunt 145 with a weld 165. Preferably, the outer jacket 155 and insert 160 are tubular members; however, their shape is not essential to the invention. Preferably, the hole 170 is not perpendicular to the surface 145*b* of the shunt proximate the hole; however, the hole may be perpendicular to the surface of the shunt proximate the hole.

Assembly of the nozzle assembly 150 is as follows. The insert 160 is inserted into the hole 170 until the taper of the outer surface 160*c* of the hard insert 160 is press fit with the shunt surface 145*a* defining the hole 170 and the shoulder 160*b* is seated on the shunt surface 145*b* proximate the hole 170, so that the lip 160*a* lines the surface 145*a* and the insert 160 is secured to the shunt 145. In other words, the smallest end of the taper is inserted into the hole 170 first, and the tapered surface of the insert 160 self-centers until it becomes snugly seated against the side of the hole 170 at the surface 145*a*. This contact occurs in the approximate area of surface 160*c* on the carbide insert. The outer jacket 155 can be disposed over an outer surface of the insert 160 and securely welded with minimal handling. Assembly time is greatly reduced, as is the required skill level of the assembler. Once seated, the nozzle assembly 150 is restrained from translating or rotating relative to the shunt 145. Alignment of the insert bore and the jacket bore with the drilled hole 170 in the shunt 145 is assured. Sand slurry 13 exiting the tube, represented by arrows 175, passes through the lip 160*a* of the hard insert, not the surface 145*a* of the hole 170. The possibility of flow cutting the surface 145*a* of the hole 170 is greatly diminished.

Figure 5:
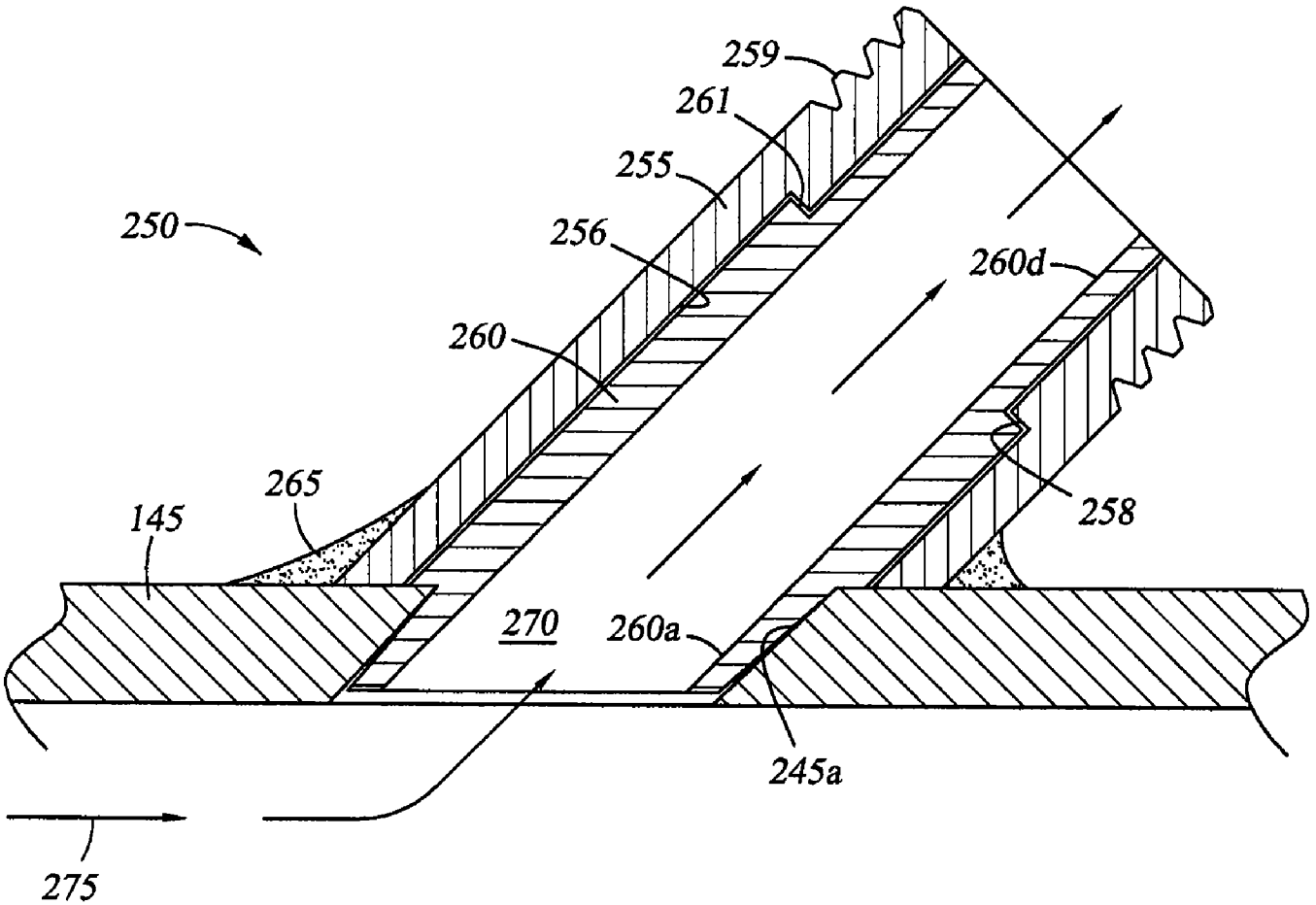
FIG. 5 is a sectional view of a nozzle assembly, according to another embodiment of the present invention, disposed on one of the shunts.

FIG. 5 is a sectional view of a nozzle assembly 250, according to another embodiment of the present invention, disposed on one of the shunts 145. The nozzle assembly 250 comprises an insert 260 with a flow bore therethrough. Preferably, the insert 260 is made from a hard material, e.g., carbide, relative to the material of the shunt 145. A proximal lip 260*a* of the insert 260 extends into an aperture 270 in a wall of the shunt 145, thereby lining a surface 245*a* of the shunt wall that defines the aperture 270. The proximal lip 260*a* can include any of the features described above with respect to the lip 160*a* of the nozzle assembly 150 illustrated in FIG. 4 such that the nozzle assembly 250 is assembled in the same manner with the proximal lip 260*a* serving the same functions.

An outer jacket 255 of the nozzle assembly 250 includes a bore therethrough configured to receive the insert 260. Specifically, a recess 256 along an inner diameter of the outer jacket 255 proximate the aperture 270 accommodates an outer diameter of a medial length of the insert 260. A distal extension 260*d* extends from an opposite end of the insert 260 than the proximal lip 260*a* and has a reduced outer diameter with respect to the medial length of the insert 260 to form an outward shoulder 261. Accordingly, the outer jacket 255 easily slips over the insert 260 and secures to the shunt 145 with a weld 265. Once welded, an inward shoulder 258 defined by the recess 256 of the outer jacket 255 mates with the outward shoulder 261 of the insert 260 to prevent outward movement of the insert 260 with respect to the aperture 270.

The insert 260 and the outer jacket 255 preferably share a common terminus due to a sufficiently sized length of the distal extension 260*d* of the insert 260. In other words, the insert 260 concentrically disposed within the outer jacket 255 lines substantially the entire length of the inner diameter of the outer jacket 255. Threads 259 on an outside end of the outer jacket 255 can replace inner threads to enable securing of a cap (not shown) to the nozzle assembly 250 if desired.

Preferably, the outer jacket 255 and insert 260 are tubular members; however, their shape is not essential to the invention. As with other embodiments described herein, sand slurry 13 exiting the shunt 145, represented by arrows 275, passes through the proximal lip 260*a* of the insert in order to reduce wear on the surface 245*a* of the aperture 270. In addition, sand slurry 13 exiting the nozzle assembly 250 passes through the distal extension 260*d* of the insert 260 without flowing through and contacting an end of the outer jacket 255, which may be made of a softer material similar to the shunt 145. In this manner, the distal extension 260*d* protects the shoulders 258, 261 that cooperate to keep the insert 260 from escaping and causing failure at the nozzle assembly 250. Thus, the insert 260 can provide a carbide conduit that protects all other portions of the nozzle assembly 250 from flow cutting since sand slurry exiting the shunt 145 passes substantially entirely through the carbide conduit. The possibility of flow cutting the surface 245*a* of the aperture 270 or the end of the outer jacket 255 is greatly diminished.

Figure 6:
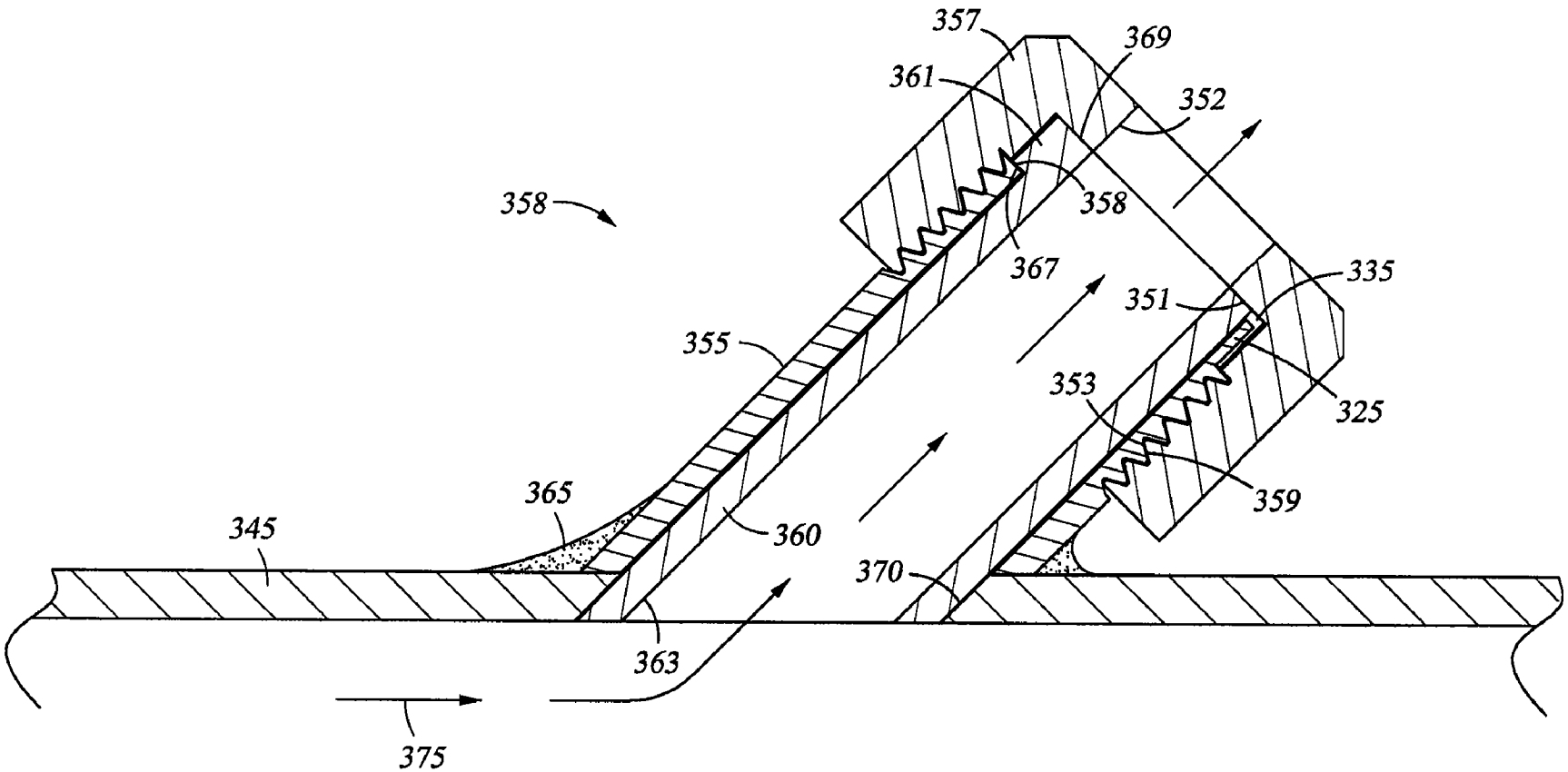
FIG. 6 is a sectional view of a nozzle assembly, according to yet another embodiment of the invention, disposed on a shunt.

FIG. 6 shows a nozzle assembly 350 disposed on a shunt 345. The nozzle assembly 350 includes an insert 360, an outer jacket 355, and a cap 357 that all provide a flow bore exiting the shunt 345 at an aperture 370 in a wall of the shunt 345. The insert 360 may be made from a hard material, e.g., carbide, relative to the material of the shunt 345. A proximal end 363 of the insert 360 extends into the aperture 370 in the wall of the shunt 345, thereby lining a surface of the shunt wall that defines the aperture 370. The insert 360 may extend to terminate substantially flush with an inner diameter of the shunt 345 at the proximal end 363 of the insert 360.

The outer jacket 355 may define a tubular shape that receives the insert 360 and may be secured to the shunt 345 with a weld 365. A distal end 361 of the insert 360 includes an enlarged outer diameter portion that creates an outward facing shoulder 367. A mating surface such as a distal terminal face 358 of the jacket 355 abuts the outward facing shoulder 367 of the insert 360 since the inner diameter of the jacket 355 is smaller than the enlarged outer diameter portion of the insert 360. The jacket 355 thus retains the insert 360 from further inward movement into the aperture 370 and ensures that the proximal end 363 of the insert 360 lines the aperture 370 due to the corresponding lengths of the jacket 355 and of the insert 360 from the proximal end 363 to the outward facing shoulder 367.

An annular nut or otherwise open cap 357 prevents outward movement of the insert 360 with respect to the aperture 370 of the shunt 345. Once the nozzle assembly 350 is put together, the insert 360 becomes trapped by the jacket 355 and the cap 357 from sliding movement relative to the jacket 355. The cap 357 includes internal threads 353 threaded with external threads 359 on the jacket 355 and a central opening 352 aligned with a bore of the insert 360. The cap 357 extends beyond the enlarged diameter portion of the insert 360 and has an inward facing shoulder 351 retaining a mating surface such as a distal terminus 369 of the insert 360.

Sand slurry (represented by arrows 375) exiting the shunt 345 passes through the insert 360 in order to reduce wear on the shunt 345 at the aperture 370. The sand slurry 375 passes through the nozzle assembly 350 without contacting the outer jacket 355, which may be made of a softer material similar to the shunt 345. For some embodiments, the cap 357 may also be constructed of a hard material, e.g., carbide, like the insert 360. The cap 357 further enables replacement of the insert 360 without removing the jacket 355 from the shunt 345 such that a selected type of the insert 360 or a new replacement of the insert 360 may be installed at any time.

Figure 7:
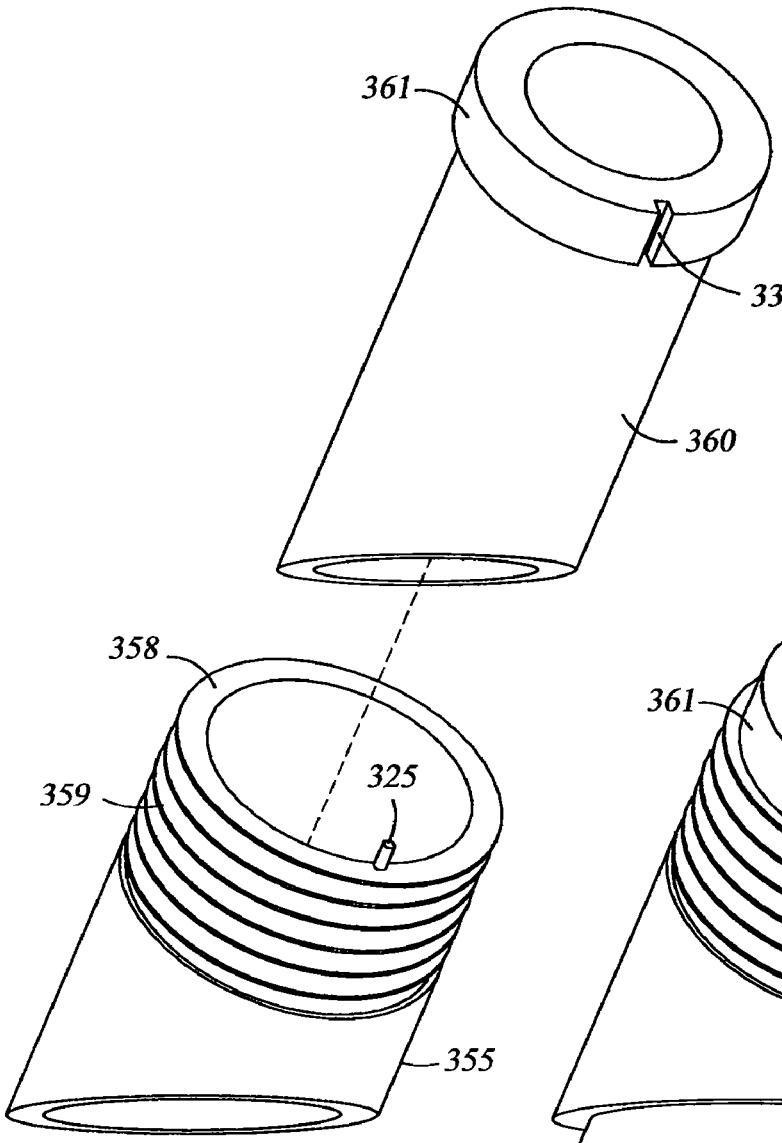
FIG. 7 is an exploded perspective view of an insert and jacket of the nozzle assembly shown in FIG. 6.

FIG. 7 illustrates the jacket 355 prior to placement of the insert 360 inside the jacket 355. Since the nozzle assembly 350 is oriented with an angled aspect on the shunt 345, both the jacket 355 and the insert 360 must align with a mating rotational orientation to seat flush on the shunt 345. A rotational keyed arrangement between the insert 360 and the jacket 355 ensures that the insert 360 is installed with a long side of the insert 360 corresponding to a long side of the jacket 355 and that this alignment is maintained during operation. For some embodiments, the keyed arrangement includes a longitudinal slot 335 in the enlarged outer diameter portion of the insert 360 at a circumferential location around the distal end 361. The circumferential location matches a respective circumferential location of the jacket 355 where a pin 325 extends from the distal terminal face 358 of the jacket 355.

Figure 8:
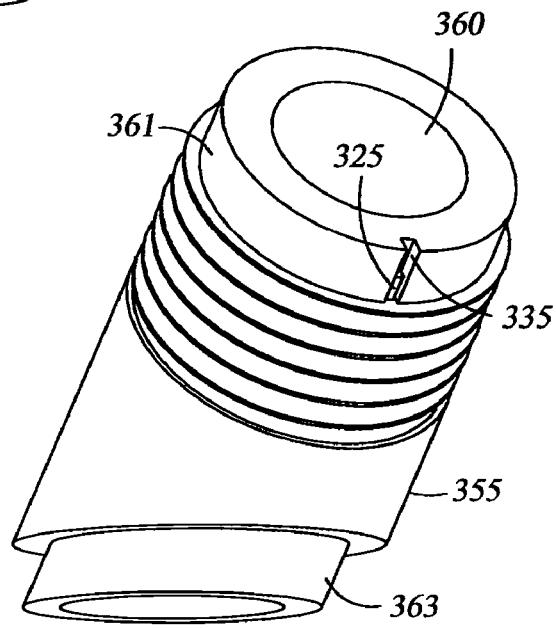
FIG. 8 is a perspective view of the insert and jacket of the nozzle assembly shown in FIG. 6 assembled together.

FIG. 8 shows the insert 360 disposed inside of the jacket 355. The jacket 355 supports the distal end 361 of the insert 360 with the proximal end 363 of the insert 360 extending beyond the jacket 355. Further, the pin 325 on the jacket 355 engages with the slot 335 on the insert 360 to lock the insert 355 rotationally with respect to the jacket 355 and in proper orientation with the aperture 370 in the shunt 345.

As shown, the nozzle assemblies 150, 250, 350 are used with a shunt of a gravel pack apparatus; however, the nozzle assemblies described herein may be used with various other apparatuses. While the foregoing is directed to embodiments of the present invention, other and further embodiments of the invention may be devised without departing from the basic scope thereof, and the scope thereof is determined by the claims that follow.

What is claimed is:

1. A nozzle assembly for use in a gravel pack tool having an aperture through a wall of a shunt along the tool, comprising:

an insert having a proximal end at least partially lining the aperture, wherein the insert has an outward facing shoulder distal to the aperture; and a jacket concentrically surrounding the insert, wherein the jacket is secured to an outer surface of the wall and has a face in abutment with the shoulder, wherein the shoulder of the insert is trapped against the face of the jacket to prevent movement of the insert into the aperture.

2. The assembly of claim 1, wherein the insert is longer than the jacket.

3. The assembly of claim 1, wherein the face of the jacket is a distal terminus of the jacket.

4. The assembly of claim 1, further comprising an open cap secured to an outer surface of the jacket at a distal end of the jacket, wherein the outward facing shoulder is disposed between an inward facing shoulder of the cap and the face of the jacket.

5. The-assembly of claim 1, further comprising an open cap threaded to an outer surface of the jacket, wherein the outward facing shoulder is disposed between an inward facing shoulder of the cap and the face of the jacket.

6. The assembly of claim 5, wherein the face of the jacket is a distal terminus of the jacket.

7. The assembly of claim 1, further comprising an annular cap secured to a distal end of the jacket and having an inward facing shoulder abutting a distal terminus of the insert.

8. The assembly of claim 1, wherein the insert is removable without removing the jacket from the tool.

9. The assembly of claim 1, further comprising a reference feature disposed on the jacket for mating with a rotational alignment feature disposed on the insert.

10. The assembly of claim 9, wherein the reference feature is a pin on the face of the jacket and the alignment feature is a slot along the outward facing shoulder of the insert.

11. The assembly of claim 9, wherein the insert is constructed from a carbide material.

12. The assembly of claim 1, wherein the outward facing shoulder is defined by an enlarged outer diameter portion.

13. The assembly of claim 12, wherein the enlarged outer diameter is larger than an inner diameter of the aperture.

14. The assembly of claim 12, further comprising an open cap secured to an outer surface of the jacket at a distal end of the jacket.

15. The assembly of claim 14, wherein the outward facing shoulder is disposed between an inward facing shoulder of the cap and the face of the jacket.

16. The assembly of claim 12, wherein the face of the jacket is a distal terminus of the jacket.

17. The assembly of claim 12, wherein the insert is removable without removing the jacket from the tool.

18. The assembly of claim 12, further comprising a reference feature disposed on the jacket for mating with a rotational alignment feature disposed on the insert.

19. The assembly of claim 18, wherein the reference feature is a pin on the face of the jacket and the alignment feature is a slot along the outward facing shoulder of the insert.

20. An apparatus for use in a wellbore, comprising:

a wellscreen assembly;

at least one shunt disposed on the wellscreen assembly and having an aperture through a wall of the shunt;

an insert having a proximal end at least partially lining the aperture, wherein the insert has an outward facing shoulder distal to the aperture;

a jacket concentrically surrounding the insert, wherein a first end of the jacket is secured to an outer surface of the wall and a second end of the jacket terminates in abutting contact with the shoulder; and an open cap secured to the jacket, wherein an inward facing shoulder of the cap abuts a distal terminus of the insert.

21. The apparatus of claim 20, wherein at least substantially an entire length of an inner diameter of the jacket is lined by the insert.

22. The apparatus of claim 20, wherein the insert is rotationally keyed with respect to the jacket.

23. The apparatus of claim 20, wherein the cap is threaded to the jacket.

24. The apparatus of claim 20, wherein the insert is constructed of a material substantially harder than a material of the shunt.

25. A nozzle assembly for use in a gravel pack tool having an aperture through a wall of a shunt along the tool, comprising:

an insert having a proximal end at least partially lining the aperture, wherein the insert has an enlarged outer diameter at a distal end of the insert relative to the aperture;

a jacket concentrically surrounding the insert, wherein the jacket is secured to an outer surface of the wall at a first end and has an inner diameter smaller than the enlarged outer diameter of the insert, which abuts a second end of the jacket at the enlarged outer diameter; and an open cap secured to the second end of the jacket and extending beyond the enlarged outer diameter of the insert, wherein an opening through the cap has a restricted diameter smaller than the enlarged outer diameter of the insert, which is thereby trapped relative to the jacket.

26. The apparatus of claim 25, wherein the cap is threaded to an outer surface of the jacket.

27. The apparatus of claim 25, wherein the insert is removable without removing the jacket from the tool.

28. A nozzle assembly for use in a gravel pack tool having an aperture through a wall of a shunt along the tool, comprising:

an insert having a proximal end at least partially lining the aperture, wherein the insert has an outward facing shoulder distal to the aperture; and a jacket concentrically surrounding the insert, wherein the jacket is secured to an outer surface of the wall and has a face in abutment with the shoulder, wherein the insert is longer than the jacket.

29. A nozzle assembly for use in a gravel pack tool having an aperture through a wall of a shunt along the tool, comprising:

an insert having a proximal end at least partially lining the aperture, wherein the insert has an outward facing shoulder distal to the aperture; and a jacket concentrically surrounding the insert, wherein the jacket is secured to an outer surface of the wall and has a face in abutment with the shoulder, wherein the face of the jacket is a distal terminus of the jacket.

30. A nozzle assembly for use in a gravel pack tool having an aperture through a wall of a shunt along the tool, comprising:

an insert having a proximal end at least partially lining the aperture, wherein the insert has an outward facing shoulder distal to the aperture;

a jacket concentrically surrounding the insert, wherein the jacket is secured to an outer surface of the wall and has a face in abutment with the shoulder; and an open cap secured to an outer surface of the jacket at a distal end of the jacket, wherein the outward facing shoulder is disposed between an inward facing shoulder of the cap and the face of the jacket.

31. A nozzle assembly for use in a gravel pack tool having an aperture through a wall of a shunt along the tool, comprising:

an insert having a proximal end at least partially lining the aperture, wherein the insert has an outward facing shoulder distal to the aperture;

a jacket concentrically surrounding the insert, wherein the jacket is secured to an outer surface of the wall and has a face in abutment with the shoulder; and an open cap threaded to an outer surface of the jacket, wherein the outward facing shoulder is disposed between an inward facing shoulder of the cap and the face of the jacket.

32. The assembly of claim 30, wherein the face of the jacket is a distal terminus of the jacket.

33. A nozzle assembly for use in a gravel pack tool having an aperture through a wall of a shunt along the tool, comprising:

an insert having a proximal end at least partially lining the aperture, wherein the insert has an outward facing shoulder distal to the aperture;

a jacket concentrically surrounding the insert, wherein the jacket is secured to an outer surface of the wall and has a face in abutment with the shoulder; and an annular cap secured to a distal end of the jacket and having an inward facing shoulder abutting a distal terminus of the insert.

34. A nozzle assembly for use in a gravel pack tool having an aperture through a wall of a shunt along the tool, comprising:

an insert having a proximal end at least partially lining the aperture, wherein the insert has an outward facing shoulder distal to the aperture; and a jacket concentrically surrounding the insert, wherein the jacket is secured to an outer surface of the wall and has a face in abutment with the shoulder, wherein the insert is removable without removing the jacket from the tool.

35. A nozzle assembly for use in a gravel pack tool having an aperture through a wall of a shunt along the tool, comprising:

an insert having a proximal end at least partially lining the aperture, wherein the insert has an outward facing shoulder distal to the aperture;

a jacket concentrically surrounding the insert, wherein the jacket is secured to an outer surface of the wall and has a face in abutment with the shoulder; and a reference feature disposed on the jacket for mating with a rotational alignment feature disposed on the insert.

36. The assembly of claim 35, wherein the reference feature is a pin on the face of the jacket and the alignment feature is a slot along the outward facing shoulder of the insert.

37. The assembly of claim 35, wherein the insert is constructed from a carbide material.

* * * * *

UNITED STATES PATENT AND TRADEMARK OFFICE

CERTIFICATE OF CORRECTION

PATENT NO. : 7,597,141 B2
APPLICATION NO. : 11/551571
DATED : October 6, 2009
INVENTOR(S) : Rouse et al.

It is certified that error appears in the above-identified patent and that said Letters Patent is hereby corrected as shown below:

Column 10, Claim 32, Line 14, please delete "30" and insert --31-- therefor.

Signed and Sealed this

Twenty-sixth Day of January, 2010

David J. Kappos

David J. Kappos
*Director of the United States Patent and Trademark Office*